US011021780B2

(12) United States Patent
Ota et al.

(10) Patent No.: US 11,021,780 B2
(45) Date of Patent: Jun. 1, 2021

(54) METHOD FOR MANUFACTURING NICKEL-BASED ALLOY HIGH-TEMPERATURE COMPONENT

(71) Applicant: Mitsubishi Power, Ltd., Yokohama (JP)

(72) Inventors: Atsuo Ota, Yokohama (JP); Shinya Imano, Yokohama (JP)

(73) Assignee: Mitsubishi Power, Ltd., Yokohama (JP)

( * ) Notice: Subject to any disclaimer, the term of this patent is extended or adjusted under 35 U.S.C. 154(b) by 117 days.

(21) Appl. No.: 16/348,774

(22) PCT Filed: Nov. 16, 2016

(86) PCT No.: PCT/JP2016/083931
§ 371 (c)(1),
(2) Date: May 9, 2019

(87) PCT Pub. No.: WO2018/092204
PCT Pub. Date: May 24, 2018

(65) Prior Publication Data
US 2020/0056275 A1 Feb. 20, 2020

(51) Int. Cl.
*C22F 1/10* (2006.01)
*B21J 5/00* (2006.01)
*C22C 19/05* (2006.01)

(52) U.S. Cl.
CPC ..... *C22F 1/10* (2013.01); *B21J 5/00* (2013.01); *C22C 19/055* (2013.01)

(58) Field of Classification Search
CPC ..... C22F 1/10; C22C 19/055; C22C 19/056; C22C 19/05
See application file for complete search history.

(56) References Cited

U.S. PATENT DOCUMENTS

| | | | |
|---|---|---|---|
| 5,547,523 | A | 8/1996 | Blankenship, Jr. et al. |
| 2004/0221927 | A1 | 11/2004 | Raymond et al. |
| 2009/0214379 | A1 | 8/2009 | Yoshinari et al. |
| 2011/0223055 | A1 | 9/2011 | Semba et al. |
| 2014/0234155 | A1 | 8/2014 | Semba et al. |
| 2015/0159241 | A1 | 6/2015 | Hamaguchi et al. |
| 2015/0368774 | A1 | 12/2015 | Ota et al. |
| 2016/0160334 | A1 | 6/2016 | Imano et al. |
| 2016/0201167 | A1 | 7/2016 | Suzuki et al. |
| 2018/0057921 | A1 | 3/2018 | Kobayashi et al. |
| 2020/0131614 | A1 | 4/2020 | Ota et al. |

FOREIGN PATENT DOCUMENTS

| | | | |
|---|---|---|---|
| CN | 1587649 | A | 3/2005 |
| CN | 101377132 | A | 3/2009 |
| CN | 102031418 | A | 4/2011 |
| CN | 102171373 | A | 8/2011 |
| CN | 103717767 | A | 4/2014 |
| CN | 104379786 | A | 2/2015 |
| CN | 105200268 | A | 12/2015 |
| EP | 0 787 815 | A1 | 8/1997 |
| EP | 1 195 446 | A1 | 4/2002 |
| EP | 2 407 565 | A1 | 1/2012 |
| JP | 60-116740 | A | 6/1985 |
| JP | 2-133133 | A | 5/1990 |
| JP | 4-41641 | A | 2/1992 |
| JP | 8-85838 | A | 4/1996 |
| JP | 2015-193045 | A | 11/2015 |
| JP | 5869624 | B2 | 2/2016 |
| JP | 5985754 | B2 | 9/2016 |
| JP | WO 2016/152982 | A1 | 11/2017 |
| WO | WO 2015/008343 | A1 | 1/2015 |
| WO | WO 2016/152982 | A1 | 9/2016 |

OTHER PUBLICATIONS

Chinese-language Office Action issued in Chinese Application No. 201580081940.0 dated Aug. 14, 2020 with partial English translation (eight (8) pages).
International Search Report (PCT/ISA/210) issued in PCT Application No. PCT/JP2016/083931 dated Feb. 21, 2017 with English translation (five pages).
Japanese-language Written Opinion (PCT/ISA/237) issued in PCT Application No. PCT/JP2016/083931 dated Feb. 21, 2017 (three pages).
Extended European Search Report issued in European Application No. 16921781.7 dated Mar. 27, 2020 (six (6) pages).
Chinese-language Office Action issued in Chinese Application No. 201680090850.2 dated Jun. 30, 2020 with English translation (12 pages).
Hindi-language Office Action issued in Indian Application No. 201917017397 dated Feb. 26, 2021 with partial English translation (five (5) pages).

*Primary Examiner* — Jessee R Roe
(74) *Attorney, Agent, or Firm* — Crowell & Moring LLP

(57) ABSTRACT

This method for manufacturing a high-temperature component formed of a Ni-based alloy includes a step of subjecting a workpiece of the Ni-based alloy to hot die forging using predetermined dies to form a forge-molded article, the step including: a die/workpiece co-heating substep of heating the workpiece interposed between the dies to a forging temperature; and a hot forging substep of taking out the workpiece and the dies into a room temperature environment and immediately performing hot forging on the workpiece using a press machine. The predetermined dies are formed of another Ni-based superalloy comprising γ and γ' phases, and have features in that: a solvus temperature of the γ' phase is 1050-1250° C.; and the γ' phase precipitates at least 10 vol. % at 1050° C. and has two kinds of forms of intra-grain γ' phase precipitations within the γ phase grains and inter-grain γ' phase precipitations between/among the γ phase grains.

5 Claims, 4 Drawing Sheets

METHOD FOR MANUFACTURING NICKEL-BASED ALLOY HIGH-TEMPERATURE COMPONENT

TECHNICAL FIELD OF THE INVENTION

The present invention relates to techniques of manufacturing high-temperature components such as steam turbine components, and in particular, to a method for manufacturing a high-temperature component formed of a nickel-based alloy having a high-temperature strength higher than heat-resistant steels.

DESCRIPTION OF BACKGROUND ART

In recent years, from the viewpoint of energy conservation (e.g. conservation of fossil fuels) and global environmental protection (e.g. reduction of $CO_2$ gas emissions), there has been a strong demand for improved efficiency of thermal power generation plants (e.g. improved efficiency of steam turbines). An effective way of improving the efficiency of steam turbines is increasing a temperature of the main steam.

For example, in current state-of-the-art ultra-supercritical-pressure power plants (USC power plants), the main steam temperature reaches the 600° C. level (approximately 600-620° C.) and the transmission end efficiency is around 42%. On the other hand, projects to develop advanced ultra-supercritical-pressure power plants (A-USC power plants) are underway in countries around the world with an aim to further improve efficiency by increasing the main steam temperature to the 700° C. level (approximately 700-720° C.). Elevation of the main steam temperature to the 700° C. level is expected to bring about a significant improvement in transmission end efficiency (e.g. by about 4%).

Usually, for high-temperature components in 600° C.-level USC power plants (e.g. turbine rotor blades), heat-resistant steels, which are iron (Fe)-based alloys such as ferritic heat-resistant steels and austenitic heat-resistant steels, are used. In contrast, materials for high-temperature components in 700° C.-level A-USC power plants are required to maintain certain mechanical properties (e.g. creep strength) that are necessary and sufficient at such a high main steam temperature, and it is assumed that nickel (Ni)-based alloys, which are superior to heat-resistant steels in high-temperature strength, are used for the components.

High-temperature components in the power plants are often manufactured by hot die forging to ensure that they have necessary mechanical properties. In hot die forging, from the viewpoint of shape accuracy, it is important to make sure that the difference in deformation resistance between the dies and the material to be forged is large (i.e. the material to be forged is easily deformed and the dies are hardly deformed). In order to increase the difference in deformation resistance between the dies and the material to be forged, when a conventional heat-resistant steel is subjected to hot die forging, for example, only the steel is heated to the forging temperature, and immediately after it is taken out from the heater, it is subjected to a forging press process with unheated dies.

However, as for Ni-based alloys (in particular, γ' phase precipitation-strengthened Ni-based alloys), if the difference in temperature between the dies and the material to be forged is large, the contact between the dies and the material to be forged causes a rapid fall in the temperature at the contact surface of the material to be forged, which triggers the onset of γ' phase precipitation, resulting in a rapid hardening of the material to be forged. This leads to a rapid increase in the deformation resistance and a decrease in the ductility of the material to be forged, which can cause a forging yield loss or damage to the dies. This means an increased manufacturing cost of high-temperature components formed of Ni-based alloys.

For this reason, various techniques to solve such problems of hot die forging for Ni-based alloy materials have been suggested (e.g. techniques of hot die forging with heated dies, and isothermal forging techniques).

For example, Patent Literature 1 (JP Hei 2 (1990)-133133 A) discloses a hot precision die forging method. In this method, a heated material to be shaped is forged on a hydraulic press using dies heated to almost the same temperature as the heating temperature of the material to be shaped. During the period from the start to the end of pressurization, a predetermined pressurizing force is constantly applied such that the stress applied to the impression side of the dies does not exceed the deformation resistance value of the material of the dies.

Also, Patent Literature 2 (JP 2015-193045 A) discloses a method for manufacturing a forged product including a first step, a second step, and a third step. In the first step, a lower die and an upper die disposed facing the lower die are heated with a heater arranged around the lower and the upper dies. In the second step, a material to be forged is placed on the heated lower die. In the third step, the material is hot die forged. The heater has a lower-side heating part and an upper-side heating part that are divided in a direction in which the lower die and the upper die face each other. The first step is performed with the lower-side heating part in contact with the upper-side heating part in the facing direction, and the second step is performed with the lower-side heating part separated from the upper-side heating part in the facing direction.

CITATION LIST

Patent Literature

Patent Literature 1: JP Hei 2 (1990)-133133 A, and
Patent Literature 2: JP 2015-193045 A.

SUMMARY OF THE INVENTION

Problems to be Solved by the Invention

According to Patent Literatures 1 and 2 (JP Hei 2-133133 A and JP 2015-193045 A), in hot die forging for hard-to-work metals such as Ni-based heat-resistant alloys and titanium (Ti) alloys, downsizing of forging devices and simplification of manufacturing procedures can be made possible, and the cost of manufacturing forged products formed of such hard-to-work metals can be reduced. Patent Literatures 1 and 2 (JP Hei 2-133133 A and JP 2015-193045 A) describe that a Ni-based alloy is used as a material for the dies for hot forging.

As described above, in hot die forging, it is necessary that the deformation resistance of the dies should be larger than that of the material to be forged during the forging process. In addition, for high-temperature components of 700° C.-level A-USC power plants, it is assumed that Ni-based alloys, which are superior to heat-resistant steels in high-temperature strength and heat resistance, are used (e.g. a Ni-based alloy in which the γ' phase is precipitated in an amount of equal to or more than 20 vol. % under the operating conditions of the high-temperature component). This means that the deformation resistance of the material to be forged during the forging process and/or the temperature required for the hot die forging would become higher than assumed in Patent Literatures 1 and 2 (JP Hei 2-133133 A and JP 2015-193045 A).

However, considering the descriptions of Patent Literatures 1 and 2 (JP Hei 2-133133 A and JP 2015-193045 A), the inventions cannot be regarded as designed for performing hot die forging on such high-strength, highly heat-resistant Ni-based alloy materials. Also, no sufficient descriptions are provided as to dies that can withstand such hot die forging. In other words, if the inventions of Patent Literatures 1 and (JP Hei 2-133133 A and JP 2015-193045 A) were applied to high-temperature components of 700° C.-level A-USC power plants as they are, it would be difficult to secure a sufficient difference in deformation resistance between the dies and the material to be forged, and problems such as a forging yield loss and damage to the dies would arise (resulting in an increased manufacturing cost of the high-temperature component).

Meanwhile, dies formed of high-melting-point metals such as tungsten (W) have disadvantages of high material cost and die-manufacturing cost and being difficult to repair. Therefore, use of dies formed of high-melting-point metals results in increased costs. Also, dies formed of heat-resistant ceramic materials have disadvantage of a short life because of their low shock resistance. Therefore, use of dies formed of ceramic materials results in increased costs as well.

The present invention has been made in view of the foregoing problems, and it is an objective of the invention to provide a method that is capable of stably manufacturing high-temperature components even formed of Ni-based alloys, which are superior to heat-resistant steels in high-temperature strength and heat resistance, without significantly increasing the manufacturing cost.

Solution to Problems

According to one aspect of the invention, there is provided a method for manufacturing a high-temperature component formed of a Ni-based alloy. The method includes: a melting/casting step of melting and casting a material of the Ni-based alloy to form a workpiece; a hot die forging step of subjecting the workpiece to hot die forging using predetermined dies to form a forge-molded article, the predetermined dies being formed of a high-precipitation-strengthened Ni-based superalloy comprising a γ (gamma) phase as a matrix and a γ' (gamma prime) phase; and a solution/aging treatment step of subjecting the forge-molded article to solution treatment and aging treatment to form a precipitation-strengthened molded article. The hot die forging step in the method includes: a die/workpiece co-heating substep of heating the workpiece to a forging temperature together with the dies using a heater with the workpiece interposed between the dies; and a hot forging substep of taking the workpiece and the dies heated to the forging temperature out of the heater into a room temperature environment and immediately performing hot forging on the workpiece using a press machine. Furthermore, the predetermined dies of the high-precipitation-strengthened Ni-based superalloy have the following features: The γ' phase is precipitated in an amount of equal to or more than 10 vol. % with respect to the γ phase at 1,050° C.; a solvus temperature of the γ' phase is higher than 1,050° C. and lower than 1,250° C.; and the γ' phase has two precipitation forms of intra-grain γ' phase crystal particles that precipitate within crystal grains of the γ phase and inter-grain γ' phase crystal particles that precipitate between or among crystal grains of the γ phase.

In the invention, the γ' phase precipitation ratio and the solvus temperature of a Ni-based alloy and those of a Ni-based superalloy are available to use values which are thermodynamically calculated based on alloy compositions thereof.

In the above aspect of a method for manufacturing a high-temperature component formed of a Ni-based alloy, the following modifications and changes can be made.

(i) The high-precipitation-strengthened Ni-based superalloy may have a composition of: by mass, 10 to 25% of Cr (chromium);

more than 0% and equal to or less than 30% of Co (cobalt);

1 to 6% of Al (aluminum);

2.5 to 7% of Ti and 3 to 9% in total of Ti, Nb (niobium) and Ta (tantalum);

equal to or less than 4% of Mo (molybdenum);

equal to or less than 4% of W;

equal to or less than 0.08% of Zr (zirconium);

equal to or less than 10% of Fe;

equal to or less than 0.03% of B (boron);

equal to or less than 0.1% of C (carbon);

equal to or less than 2% of Hf (hafnium);

equal to or less than 5% of Re (rhenium); and a balance of Ni with inevitable impurities.

(ii) The forging temperature may be equal to or higher than 900° C. and equal to or lower than a temperature lower than the solvus temperature of the γ' phase in the high-precipitation-strengthened Ni-based superalloy by 20° C.

(iii) The dies may have a tensile strength of equal to or more than 450 MPa at 900° C.

(iv) The method may further include a softening step of preforming and softening the workpiece between the melting/casting step and the hot die forging step. The softening step may include: a preform forming substep of subjecting the workpiece to hot working at a temperature equal to or higher than 1,000° C. and lower than a solvus temperature of a γ' phase in the Ni-based alloy to form a preform in which crystal particles of the γ' phase (inter-grain γ' phase crystal particles) are precipitated between or among crystal grains of a γ phase as a matrix of the Ni-based alloy; and a softened preform forming substep of re-heating the preform to the temperature of the hot working to decrease γ' phase crystal particles precipitated within the γ phase crystal grains (intra-grain γ' phase crystal particles) and subsequently slowly cooling the heated preform at a cooling rate of equal to or less than 100° C./h to 500° C. to form a softened preform in which the inter-grain γ' phase crystal particles have grown. Furthermore, the hot die forging step may be performed on the softened preform.

Advantages of the Invention

According to the invention, there can be provided a method that is capable of stably manufacturing high-temperature components even formed of Ni-based alloys, which are superior to heat-resistant steels in high-temperature strength and heat resistance, without significantly increasing the manufacturing cost. As a result, there can be provided high-temperature components formed of Ni-based alloys being superior in high-temperature strength and heat resistance with a low cost.

DETAILED DESCRIPTION OF THE PREFERRED EMBODIMENTS

[Basic Concept of the Invention]

Figure 1:
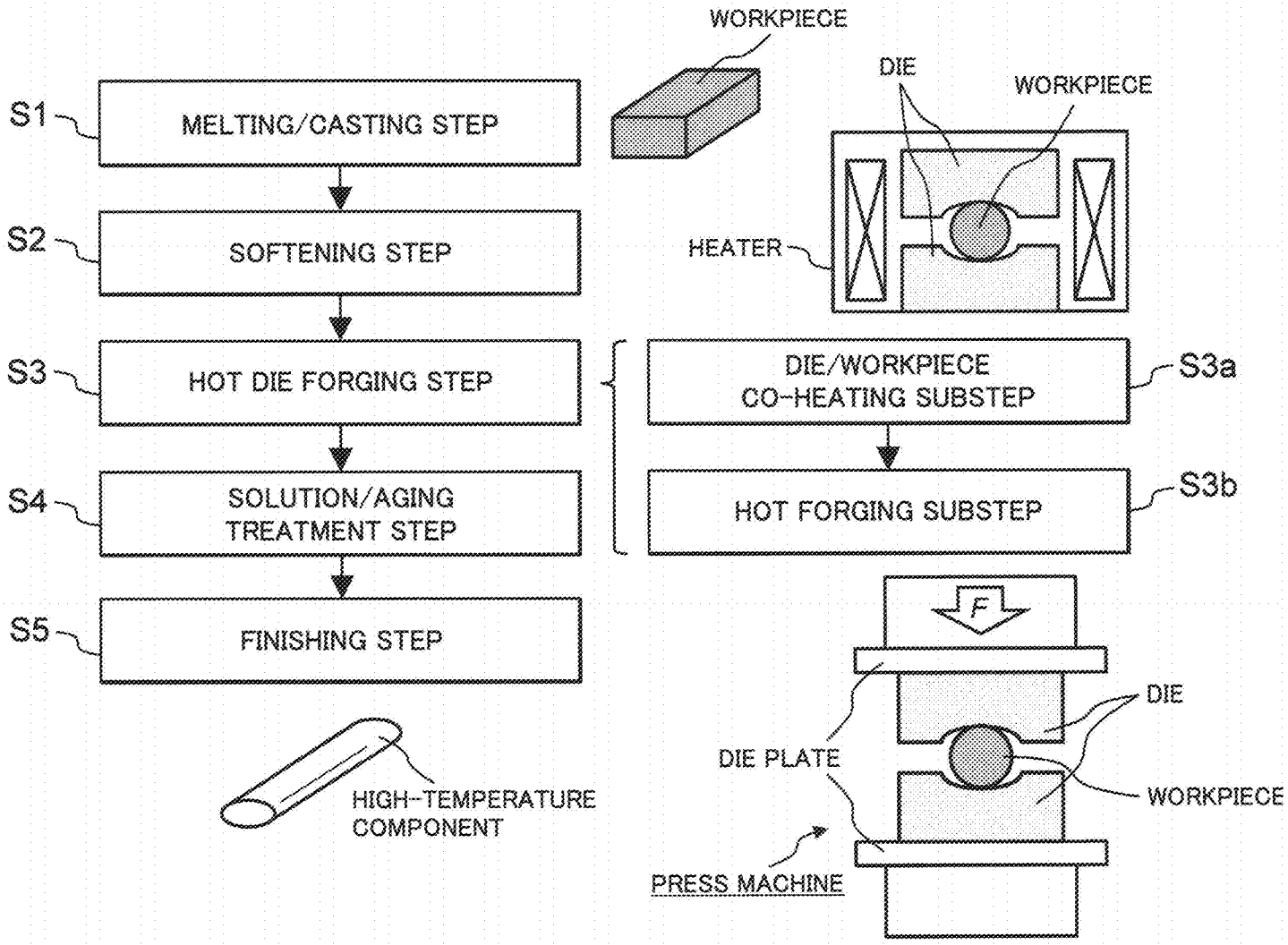
FIG. 1 is a process flow diagram illustrating a method for manufacturing a Ni-based alloy high-temperature component according to an embodiment of the present invention.

As described in Patent Literatures 1 and 2 (JP Hei 2-133133 A and JP 2015-193045 A), in conventional hot die forging, the temperature of the dies is normally set at a lower value than that of the material to be forged. This is probably to ensure that the deformation resistance of the dies is larger than that of the material to be forged during the forging process. In other words, in conventional techniques, it is difficult to prepare dies that exhibit a deformation resistance larger than that of the material to be forged at the temperature at which the material is hot die forged within an industrially acceptable cost range (i.e. at low cost).

In view of the above, the inventors deemed that if they could prepare dies that exhibit a deformation resistance larger than that of the material to be forged at the temperature at which the material is hot die forged at low cost, they would make it possible to perform hot die forging with the material to be forged and the dies under isothermal condition, thereby contributing to improving yields and reducing costs more than conventional techniques in hot die forging for Ni-based alloys excellent in high-temperature strength and heat resistance.

Therefore, the inventors studied on techniques to prepare dies that have a high-temperature strength higher than conventional dies for hot die forging at low cost. A basic way to enhance high-temperature strength would be by increasing the amount of the γ' phase precipitated in the γ phase as a matrix of a precipitation-strengthened Ni-based alloy.

Unfortunately, however, conventional high-precipitation-strengthened Ni-based superalloys containing an increased amount of the precipitated γ' phase (e.g. a Ni-based alloy in which the γ' phase is precipitated in an amount of equal to or more than 30 vol. %) have a disadvantage of having extremely poor workability because of their excessive hardness. Therefore, preparing dies for hot die forging formed of a high-precipitation-strengthened superalloy at low cost has been thought to be difficult.

To solve such a technical problem and achieve desirable workability in high-precipitation-strengthened Ni-based superalloy materials, the inventors carried out intensive research on methods for manufacturing high-precipitation-strengthened Ni-based superalloy materials with desirable workability while going back to studying the mechanism of strengthening by γ' phase precipitation. As a result, it was found that the workability of even a high-precipitation-strengthened Ni-based superalloy material can be dramatically improved by controlling the precipitation form of the γ' phase in an in-process material (by transforming part of the γ' phase crystal particles that are usually precipitated within γ phase crystal grains (referring to as intra-grain γ' phase crystal particles) into γ' phase crystal particles precipitated between/among γ phase crystal grains (referring to as inter-grain γ' phase crystal particles)).

It was also found that even a Ni-based superalloy material that has been precipitation-strengthened by aging treatment can be easily re-softened by controlling the precipitation ratio of inter-grain γ' phase crystal particles to equal to or more than 10 vol. %.

This epoch-making processing technique has made it easy to manufacture dies formed of a high-precipitation-strengthened Ni-based superalloy (i.e. dies with a high-temperature strength higher than conventional dies), making it possible to perform hot die forging with the material to be forged and the dies under isothermal condition. The present invention was made based on these findings.

Preferred embodiments of the invention will be hereinafter described with reference to the accompanying drawings. However, the invention is not to be construed as limited to the specific embodiments described below, and various combinations with known art and modifications based on known art are possible without departing from the technical spirit and scope of the present invention.

[Method for Manufacturing High-Temperature Component]

FIG. 1 is a process flow diagram illustrating a method for manufacturing a Ni-based alloy high-temperature component according to an embodiment of the invention. As shown in FIG. 1, first, a melting/casting step (S1) is performed, in which a Ni-based alloy material is melted and cast to form a workpiece. There are no particular limitations on the melting method and the casting method, and any conventional method for Ni-based alloy materials may be used.

Next, a softening step (S2) is performed as necessary, in which the workpiece is preformed and softened to form a softened preform. This step is not an indispensable step but should preferably be performed in the case where the workpiece is formed of a heat-resistant Ni-based alloy whose γ' phase solvus temperature is over 1,000° C., for example. The process and mechanism of softening will be specifically described later.

Next, a hot die forging step (S3) is performed, in which the workpiece (or softened preform) is subjected to hot die forging using predetermined dies to form a forge-molded article. The hot die forging step S3 includes a die/workpiece co-heating substep (S3*a*) and a hot forging substep (S3*b*). The greatest feature of the invention resides in this hot die forging step S3.

The predetermined dies are formed of a high-precipitation-strengthened Ni-based superalloy in which the γ' phase is precipitated in an amount of equal to or more than 10 vol. % with respect to the γ phase as a matrix, at 1,050° C. In addition, the solvus temperature of the γ' phase is higher than 1,050° C. and lower than 1,250° C. Importantly, the γ' phase has two precipitation forms: intra-grain γ' phase crystal particles, which precipitate within crystal grains of the γ phase of a matrix, and inter-grain γ' phase crystal particles, which precipitate between/among crystal grains of the γ phase.

For the high-precipitation-strengthened Ni-based superalloy, a superalloy that may preferably be used has a composition of: by mass, 10 to 25% of Cr; more than 0% and equal to or less than 30% of Co; 1 to 6% of Al; 2.5 to 7% of Ti, 3 to 9% in total of Ti, Nb and Ta; equal to or less than 4% of Mo; equal to or less than 4% of W; equal to or less than 0.08% of Zr; equal to or less than 10% of Fe; equal to or less than 0.03% of B; equal to or less than 0.1% of C; equal to or less than 2% of Hf; equal to or less than 5% of Re; and the balance of Ni with inevitable impurities.

By using dies formed of a high-precipitation-strengthened Ni-based superalloy containing a larger amount of the γ' phase precipitation, a deformation resistance higher than those of conventional dies for hot die forging can be secured.

In other words, such dies can be used in a temperature range higher than conventional dies for hot die forging. The method for manufacturing the dies will be described later.

The die/workpiece co-heating substep S3*a* is a base-step of heating the workpiece, interposed between the dies, to the forging temperature together with the dies using a heater. There are no particular limitations on the heater, and any conventional furnace may be used, for example. There are no particular limitations on the lower limit of the forging temperature, but considering that the workpiece is formed of a Ni-based alloy, it is preferably equal to or higher than 900° C. Meanwhile, the upper limit of the forging temperature is preferably lower than the solvus temperature of the γ' phase in the alloy of the dies by 20° C. From the viewpoint of preventing sticking between the dies and the workpiece, an inorganic releasing material should preferably be interposed between the dies and the workpiece.

The hot forging substep S3*b* is a base-step of subjecting the dies and workpiece heated to the forging temperature to hot forging using a press machine immediately after they were taken out of the heater to a room temperature environment. This substep S3*b* has an advantage that the temperature of the workpiece is hard to decrease because the workpiece and the dies sandwiching it are under isothermal condition and the thermal capacity of the dies is added to the workpiece. Therefore, no special systems (e.g. heating system) are required of the press machine, and any conventional press machine may be used. From the viewpoint of enhancing the heat retaining property of the dies, a heat insulating material should preferably be interposed between the die plates of the press machine and the dies.

From the viewpoint of an acceptable strain rate of the workpiece and a total reduction with respect to the workpiece, when it is difficult to form the workpiece into a desired shape in one press working operation, the die/workpiece co-heating substep S3*a* and the hot forging substep S3*b* may be performed repeatedly.

As described above, the hot die forging step S3 according to an embodiment of the invention does not require a hot forging device provided with a special system and can be performed using a conventional heater and a conventional press machine. This gives it the advantage of device cost reduction (i.e. manufacturing cost reduction).

Next, a solution/aging treatment step (S4) is performed, in which the forge-molded article is subjected to a solution treatment and an aging treatment to form a precipitation-strengthened molded article. There are no particular limitations on the solution treatment and the aging treatment, and any solution/aging treatment may be performed as long as the finished high-temperature component satisfies the property requirements.

Finally, a finishing step (S5) is performed, in which the precipitation-strengthened molded article is subjected to a finishing process to form a desired high-temperature component. There are no particular limitations on the finished process, and any conventional finishing process (e.g. surface finishing process) may be performed.

[Method for Manufacturing Dies]

As described before, a great feature of the invention resides in the fact that it is capable of preparing dies formed of a high-precipitation-strengthened Ni-based superalloy at low cost. The method for manufacturing dies to be used in the invention will be hereinafter described.

Figure 2:
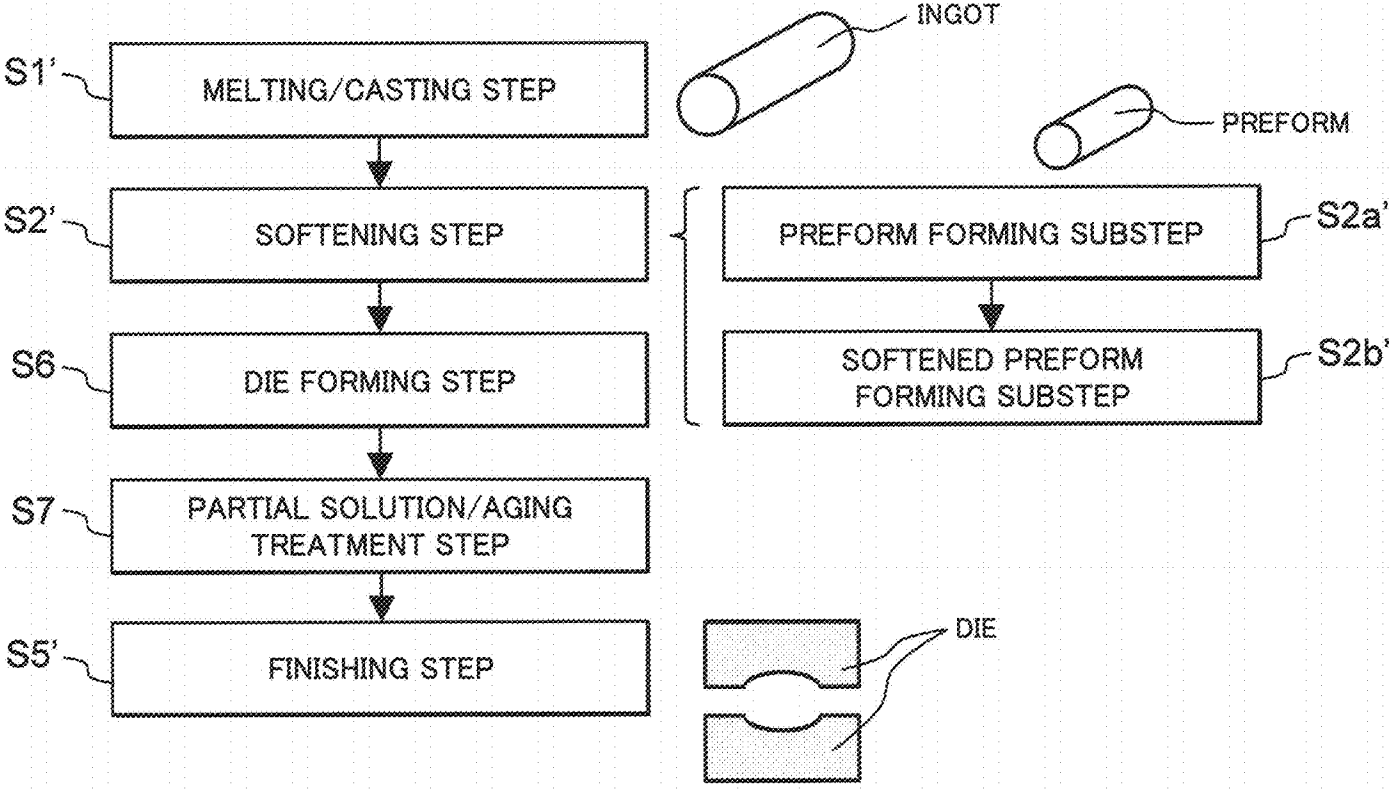
FIG. 2 is a process flow diagram illustrating a method for manufacturing dies formed of a high-precipitation-strengthened Ni-based superalloy to be used in an embodiment of the present invention.

FIG. 2 is a process flow diagram illustrating a method for manufacturing dies formed of a high-precipitation-strengthened Ni-based superalloy to be used in an embodiment of the invention. First, a melting/casting step (S1') is performed, in which a high-precipitation-strengthened Ni-based superalloy material is melted and cast to form an ingot. There are no particular limitations on the melting method or the casting method, and any conventional method for Ni-based alloy materials may be used.

As described before, for the high-precipitation-strengthened Ni-based superalloy, a superalloy that may preferably be used has a composition of: by mass, 10 to 25% of Cr; more than 0% and equal to or less than 30% of Co; 1 to 6% of Al; 2.5 to 7% of Ti, 3 to 9% in total of Ti, Nb and Ta; equal to or less than 4% of Mo; equal to or less than 4% of W; equal to or less than 0.08% of Zr; equal to or less than 10% of Fe; equal to or less than 0.03% of B; equal to or less than 0.1% of C; equal to or less than 2% of Hf; equal to or less than 5% of Re; and the balance of Ni with inevitable impurities.

Figure 3:
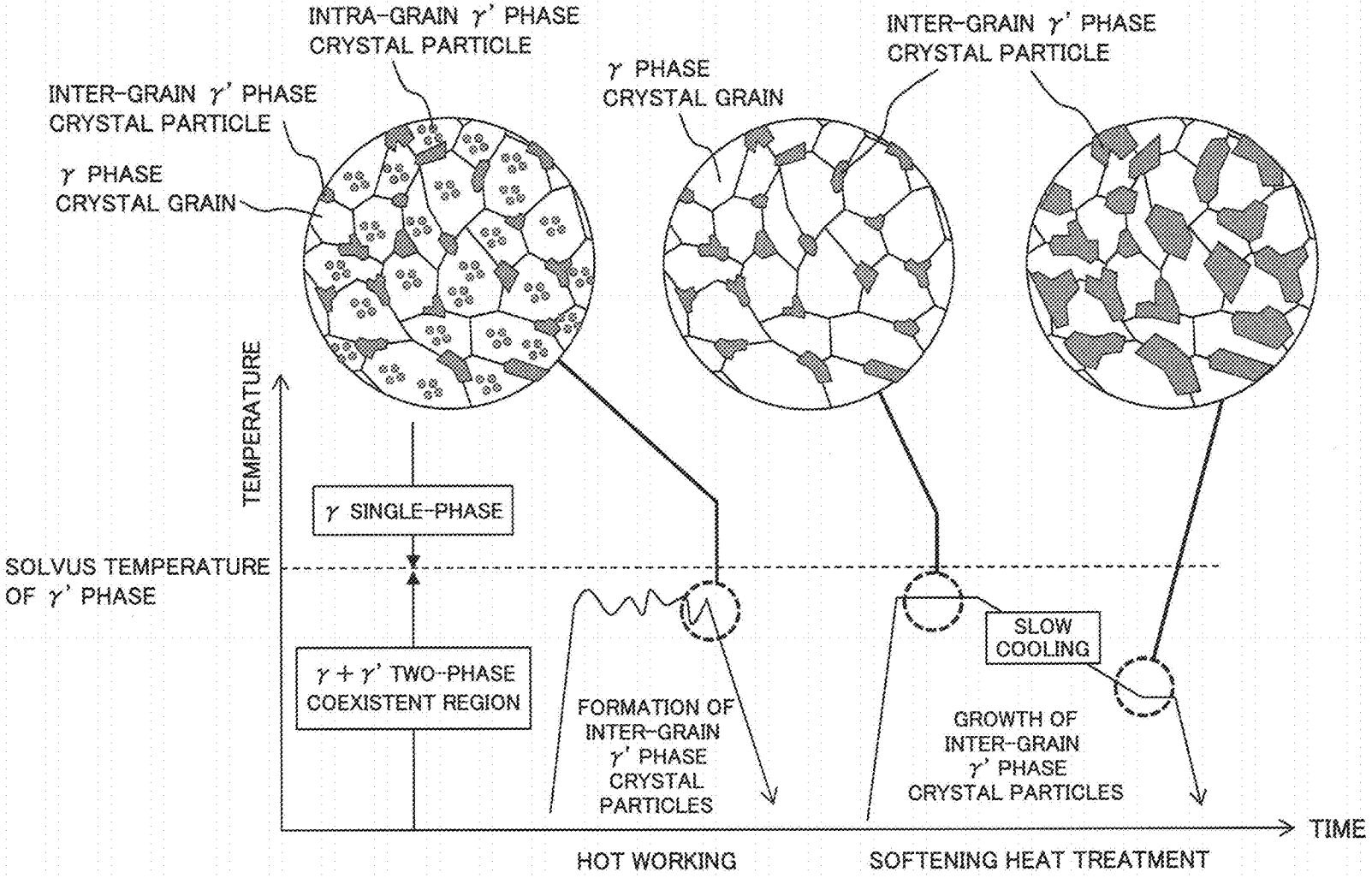
FIG. 3 is a schematic diagram illustrating a process of softening step and a change in microstructure.

Next, a softening step (S2') for improving workability is performed on the ingot. FIG. 3 is a schematic diagram illustrating the process of the softening step S2' and the change in microstructure. The softening step S2' includes of a preform forming substep (S2*a*') and a softened preform forming substep (S2*b*'). The softening step S2' is substantially the same as the softening step S2 in the method for manufacturing a high-temperature component.

The preform forming substep S2*a*' is a base-step of subjecting the ingot to hot working at a temperature equal to or higher than 1,000° C. and lower than the solvus temperature of the γ' phase in the Ni-based superalloy of the ingot (i.e. at a temperature at which the γ' phase is present) to form a preform in which γ' phase crystal particles are precipitated between/among crystal grains of the γ phase as a matrix of the Ni-based superalloy (inter-grain γ' phase crystal particles). It is preferable that a precipitation ratio of the inter-grain γ' phase crystal particles be equal to or more than 10 vol. %, and more preferably equal to or more than 20 vol. %, after the hot working. There are no particular limitations on the hot working method, and any conventional method (e.g. hot forging) may be used. Also, homogenizing treatment (soaking) may be performed on the ingot before the hot working as necessary.

The investigation and research carried out by the inventors suggested that the mechanism of γ' phase precipitation strengthening in Ni-based alloys is mainly based on an interface formed at which matrix γ phase crystal grains and precipitated intra-grain γ' phase crystal particles match well in crystal lattices (so-called coherent interface). In contrast, γ phase crystal grains and inter-grain γ' phase crystal particles form an interface at which they do not match well at their interface (so-called incoherent interface), which hardly contributes to precipitation strengthening. Based on this, the inventors found that the workability of even a high-precipitation-strengthened Ni-based superalloy can be dramatically improved by transforming intra-grain γ' phase crystal particles into inter-grain γ' phase crystal particles.

The softened preform forming substep S2*b*' is a base-step of forming a softened preform, in which the preform is subjected to softening heat treatment of re-heating the preform to the temperature of the preceding hot working to cause the intra-grain γ' phase crystal particles to enter into solid solution and decrease and subsequently slowly cooling the preform at a cooling rate of equal to or less than 100° C./h to 500° C. to allow the inter-grain γ' phase crystal particles to grow. The cooling rate until the preform reaches 500° C. is preferably equal to or less than 50° C./h, and more preferably equal to or less than 10° C./h.

Also, the slow cooling is ended at the temperature of 500° C. because it is a temperature at which the actual temperature becomes sufficiently low and rearrangement of atoms in the Ni-based alloy (i.e. generation of another phase) becomes substantially difficult.

Next, a die forming step (S6) is performed, in which the softened preform is subjected to a forming process to form a softened die having a desired shape. There are no particular limitations on the forming process, and any conventional method may be used. Furthermore, since the softened preform has excellent workability, low-cost cold working and warm working (e.g. press working and machining) may preferably be employed.

Figure 4:
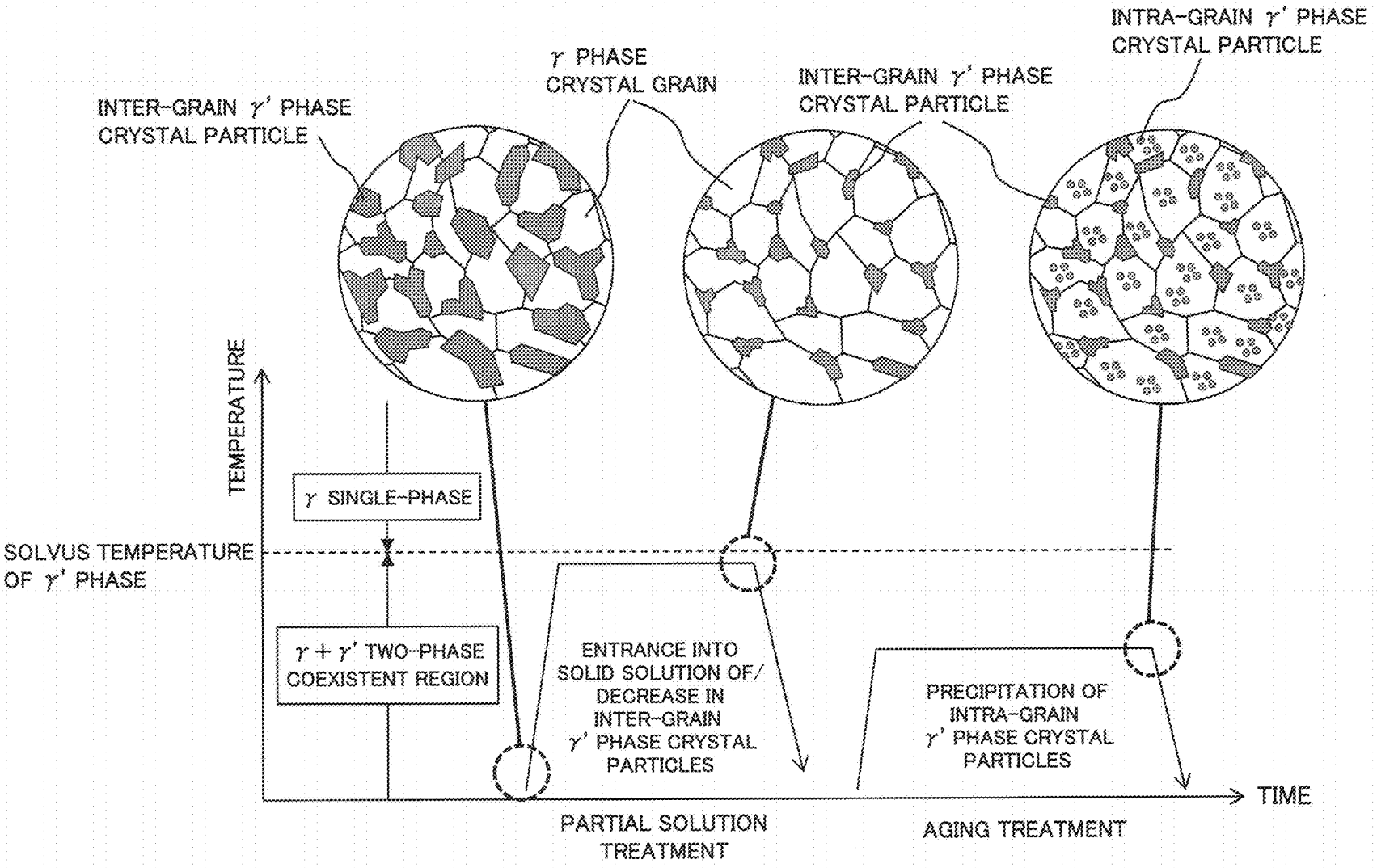
FIG. 4 is a schematic diagram illustrating a process of partial solution/aging step and a change in microstructure.

Next, a partial solution/aging treatment step (S7) is performed, in which the softened dies are subjected to partial solution treatment and aging treatment to form precipitation-strengthened dies. FIG. 4 is a schematic diagram illustrating the process of the partial solution/aging step S7 and the change in microstructure.

As shown in FIG. 4, the partial solution treatment according to the invention is a heat treatment to raise the temperature to a temperature equivalent to the temperature of the preceding hot forging. Since this temperature is lower than the solvus temperature of the γ' phase, the extent of the decrease in the precipitation amount of the γ' phase (herein inter-grain γ' phase crystal particles) is not so large as to cause all the inter-grain γ' phase crystal particles to enter into solid solution and disappear. Also, the partial solution treatment should preferably be controlled such that the precipitation ratio of the inter-grain γ' phase crystal particles is equal to or more than 10 vol. % and equal to or less than half of the entire γ' phase before the partial solution treatment. For example, the temperature of the partial solution treatment should preferably be controlled to a temperature equal to or higher than the recrystallization temperature of the γ phase and equal to or lower than a temperature lower than the solvus temperature of the γ' phase by 20° C.

The partial solution treatment is followed by aging treatment to precipitate intra-grain γ' phase crystal particles. There are no particular limitations on the aging treatment, and any conventional aging treatment (e.g. at 700 to 900° C.) may be performed.

Lastly, a finishing step (S5') is performed, in which the precipitation-strengthened dies are subjected to a finishing process to form desired dies. There are no particular limitations on the finishing process, and any conventional finishing process (e.g. surface finishing process) may be performed.

As described above, the dies to be used in the invention can be manufactured without using manufacturing equipment provided with a special system, although they are formed of a high-precipitation-strengthened Ni-based superalloy. In other words, the present invention can contribute to reducing the manufacturing cost of high-temperature components because it is capable of preparing dies that exhibit a large deformation resistance at a hot forging temperature at low cost.

[Method for Repairing Dies]

In the case where damage such as deformation occurs to a die for hot die forging as a result of employing the method for manufacturing a high-temperature component of the invention, repairs can be carried out by the following method. In other words, the dies to be used in the invention have an advantage of being easily repaired.

First, the damaged die is subjected to the softening heat treatment in the softened preform forming substep S2*b*' (see the right side in FIG. 3) of the die manufacturing method. This can cause the intra-grain γ' phase crystal particles precipitated in the partial solution/aging step S7 of the die manufacturing method to enter into solid solution and decrease while growing the inter-grain γ' phase crystal particles. This is exactly the same state as the softened preform in the die manufacturing method.

As described above, in the dies to be used in the invention, some inter-grain γ' phase crystal particles are left to remain. Therefore, it is not necessary to perform the preform forming substep S2*a*' in the die manufacturing method, and the state of the softened preform can be obtained just by performing the softened preform forming substep S2*b*'.

Next, following the softening heat treatment, the damaged die is subjected to the same forming process as in the die forming step S6 (e.g. press working and machining) to correct its shape.

Subsequently, the partial solution/aging treatment step S7 and the finishing step S5' are performed in the same manner as in the die manufacturing method to complete the repair of the damaged die.

As has been described above, the dies to be used in the invention can be repaired by an extremely simple method and reused despite the fact that they are formed of a high-precipitation-strengthened Ni-based superalloy. This feature contributes to further reducing the manufacturing cost of high-temperature components.

EXAMPLES

The present invention will be hereinafter described in more detail based on various experiments. However, the invention is not to be construed as limited to these.

[Experiment 1]

(Fabrication, Testing and Evaluation of Dies for Hot Die Forging)

Dies for hot die forging were fabricated according to the process flow diagram shown in FIG. 2. First, alloy raw materials having the compositions shown in Table 1 (Alloys 1 to 6) were prepared and subjected to the melting/casting step S1'. 100 kg of each alloy raw material was melted and cast by vacuum induction heating and melting to fabricate an ingot.

TABLE 1

Alloy Compositions of Dies for Hot Die Forging (nominal compositions).

Unit: mass %

| | Ni | Cr | Co | Al | Ti | Nb | Mo | W | Zr | Fe | B | C | Si | V |
|---|---|---|---|---|---|---|---|---|---|---|---|---|---|---|
| Alloy 1 | — | 12.5 | — | — | — | — | 1.01 | — | — | Bal. | — | 1.55 | 0.10 | 0.45 |
| Alloy 2 | Bal. | 19.8 | 20.6 | 0.52 | 2.11 | — | 6.00 | — | 0.023 | — | 0.002 | 0.050 | 0.05 | — |
| Alloy 3 | Bal. | 15.9 | 8.6 | 2.24 | 3.45 | 1.16 | 3.15 | 2.75 | 0.032 | 3.98 | 0.010 | 0.015 | — | — |
| Alloy 4 | Bal. | 13.6 | 24.8 | 2.33 | 6.19 | — | 2.82 | 1.23 | 0.032 | — | 0.016 | 0.002 | — | — |

TABLE 1-continued

Alloy Compositions of Dies for Hot Die Forging (nominal compositions).

Unit: mass %

| | Ni | Cr | Co | Al | Ti | Nb | Mo | W | Zr | Fe | B | C | Si | V |
|---|---|---|---|---|---|---|---|---|---|---|---|---|---|---|
| Alloy 5 | Bal. | 13.5 | 24.9 | 2.30 | 6.18 | — | 2.81 | 1.24 | 0.034 | — | 0.012 | 0.002 | — | — |
| Alloy 6 | Bal. | 13.4 | 25.1 | 2.32 | 6.23 | — | 2.82 | 1.23 | 0.030 | — | 0.014 | 0.002 | — | — |

"Bal." includes inevitable impurities (e.g. P, S, N, and O).
"—" indicates that the element is not intentionally included.

The γ' phase solvus temperature of each alloy and the precipitation amount of the γ' phase in each alloy at 1,050° C. were thermodynamically calculated.

Here, since Alloy 1 is an Fe-based alloy and not a precipitation-strengthened alloy, the γ' phase solvus temperature and the precipitation amount of the γ' phase at 1,050° C. are not calculated. Alloy 2 is a γ' phase-precipitation-strengthened Ni-based alloy whose γ' phase solvus temperature is about 800° C., so the precipitation amount of the γ' phase at 1,050° C. is 0 vol. %. Alloy 3 is a γ' phase-precipitation-strengthened Ni-based superalloy whose γ' phase solvus temperature is about 1,100° C., and the precipitation amount of the γ' phase at 1,050° C. is equal to or more than 10 vol. %. Alloys 4 to 6 are also γ' phase-precipitation-strengthened Ni-based superalloys whose γ' phase solvus temperature is about 1,150° C., and the precipitation amount of the γ' phase at 1,050° C. is equal to or more than 10 vol. %.

The ingots of Alloys 1 and 2 were subjected to homogenizing treatment and subsequently to hot forging at 1,050° C. as the preform forming substep S2*a*' to fabricate preforms. The ingot of Alloy 3 was subjected to homogenizing treatment and subsequently to hot forging at 1,070° C. in the preform forming substep S2*a*' to fabricate a preform. The ingots of Alloys 4 and 5 were subjected to homogenizing treatment and subsequently to hot forging in 1,100° C. as the preform forming substep S2*a*' to fabricate preforms.

Next, each of these preforms was subjected to the softened preform forming substep S2*b*', in which it was reheated to a temperature as high as the temperature of the preceding hot forging, held at the temperature for one hour, slowly cooled at a cooling rate of equal to or less than 10° C./h to 500° C., and subsequently water-cooled, to fabricate a softened preform.

As for the ingot of Alloy 6, only homogenizing treatment was performed, and neither the preform forming substep S2*a*' nor the softened preform forming substep S2*b*' was performed.

Test pieces for microstructure evaluation were taken from the preforms of Alloys 1 to 5 after the softening step S2', and the Vickers hardness of each test piece was measured using a micro Vickers hardness meter. The results showed that the softened preforms of Alloys 1 and 2 each had a Vickers hardness of equal to or more than 400 Hv, and the softened preforms of Alloys 3 to 5 each had a Vickers hardness of equal to or less than 350 Hv.

Next, each test piece for microstructure evaluation was analyzed to observe the γ' phase precipitation form using a scanning electron microscope. It was confirmed that no γ' phase precipitation was observed in the softened preform of Alloy 1 as it was not a precipitation-strengthened alloy; that only the intra-grain γ' phase was observed in the softened preform of Alloy 2 (no inter-grain γ' phase was observed; and that only the inter-grain γ' phase was observed in the softened preforms of Alloys 3 to 5 (no intra-grain γ' phase was observed).

Subsequently, each of the softened preforms of Alloys 1 to 5 was subjected to the die forming step S6 by machining to fabricate softened dies. As for the ingot of Alloy 6, it was cut into a predetermined size and then an attempt was made to subject it to machining, but it turned out to be difficult. Therefore, the dies of Alloy 6 were formed by electric discharge machining.

Since electric discharge machining is a relatively costly die forming method as compared to cold working methods such as machining and press working, it is disadvantageous in terms of die fabrication cost reduction. In other words, it has been confirmed that the softening step S2' should preferably be performed on the alloy ingot from the viewpoint of die formability and in order to reduce the cost of fabricating dies.

Next, each pair of dies of Alloys 1 to 4 were subjected to solution treatment at the same temperature as the temperature of the preceding hot forging (held at 1,050° C. to 1,100° C. for 4 hours) and aging treatment, held at 760° C. for 16 hours, to fabricate strengthened dies. Also, each pair of dies of Alloys 5 and 6 were subjected to solution treatment, held at 1,200° C. for 4 hours, and aging treatment, held at 760° C. for 16 hours, to fabricate strengthened dies. Lastly, each pair of dies were subjected to a surface finishing process as the finishing step S5' to prepare dies for hot die forging.

On the other hand, in order to evaluate the mechanical properties of the dies for hot die forging of Alloys 1 to 6, test pieces for a tensile test were fabricated separately in the same manner as above and subjected to a tensile test at 900° C. using an elevated temperature tensile tester. The results showed that the test pieces of Alloys 1 and 2 exhibited a tensile strength of less than 300 MPa, but the test pieces of Alloys 3 to 6 exhibited a tensile strength of equal to or more than 450 MPa.

[Experiment 2]

(Fabrication of Ni-Based Alloy High-Temperature Components)

High-temperature components were fabricated of a Ni-based alloy using the dies for hot die forging prepared in Experiment 1 according to the process flow diagram shown in FIG. 1. First, an alloy raw material having a composition shown in Table 2 was prepared and subjected to the melting/casting step S1, in which 100 kg of the alloy raw material was melted by vacuum induction heating and melting and cast to fabricate workpieces.

TABLE 2

Composition of Workpiece (nominal composition).

Unit: mass %

| | Ni | Cr | Al | Ti | Mo | B | C |
|---|---|---|---|---|---|---|---|
| Workpiece | Bal. | 21.0 | 1.20 | 1.63 | 10.5 | 0.001 | 0.020 |

"Bal." includes inevitable impurities (e.g. P, S, N, and O).

In order to evaluate the mechanical properties of the workpieces, a test piece for a tensile test was taken from a portion of the workpieces and subjected to a tensile test at 900° C. using an elevated temperature tensile tester. The workpiece test piece exhibited a tensile strength of about 300 MPa.

Next, each workpiece was subjected to the hot die forging step S3, in which it was hot die forged using each pair of dies prepared in Experiment 1 to form a forge-molded article. First, the die/workpiece co-heating substep S3*a* was performed, in which both of the workpiece and the dies were heated to 1,000° C. using a heater with the workpiece interposed between the dies.

Next, the hot forging substep S3*b* was performed, in which the dies and the workpiece, heated to 1,000° C., were subjected to hot forging using a press machine (pressurizing force: 4,000 tons) immediately after they were taken out of the heater into a room temperature environment.

After the press working, each workpiece and the dies were examined for changes in shape. In the case where the dies of Alloys 1 and 2 were used, almost no shape change was found in the workpiece, but the dies themselves had been significantly deformed. In contrast, in the case where the dies of Alloys 3 to 6 were used, the workpiece had been shaped into the target shape, and no deformation was observed in the dies.

[Experiment 3]

(Evaluation of Repairability of Dies for Hot Die Forging)

The dies of Alloys 3 to 6, which exhibited good hot die forgeability in Experiment 2, were evaluated for repairability (whether they were repairable or not). First, the dies of Alloys 3 to 6 used in Experiment 2 were subjected to the softening heat treatment of the softened preform forming substep S2*b*' in Experiment 1.

Specifically, the dies of Alloy 3 were subjected to a softening heat treatment in which they were heated to 1,070° C., held at the temperature for one hour, slowly cooled at a cooling rate of 10° C./h to 500° C., and water-cooled. The dies of Alloys 4 to 6 were subjected to a softening heat treatment in which they were heated to 1,100° C., held at the temperature for one hour, slowly cooled at a cooling rate of 10° C./h to 500° C., and water-cooled.

Next, after the softening heat treatment, each die was subjected to cold machining. As a result, it was revealed that the dies of Alloys 3 and 4 were cold-machinable (i.e. repairable), but the dies of Alloys 5 and 6 were difficult to cold-machine (i.e. substantially unrepairable).

The dies of Alloys 3 and 4 had been subjected to the solution/aging treatment step S7 of the invention as a solution/aging treatment to fabricate strengthened dies. In contrast, the dies of Alloys 5 and 6 had been subjected to a conventional solution/aging treatment, in which the dies were heated to a temperature higher than the solvus temperature of the γ' phase as a solution treatment. Therefore, it was believed that inter-grain γ' phase crystal particles had hardly precipitated and as a result the softening heat treatment did not give the dies good repairability. In other words, it has been confirmed that in order to secure good die repairability, the presence of inter-grain γ' phase crystal particles is important.

The above-described embodiments and Examples have been specifically given in order to help with understanding on the present invention, but the invention is not limited to the described embodiments and Examples. For example, a part of an embodiment may be replaced by known art, or added with known art. That is, a part of an embodiment of the invention may be combined with known art and modified based on known art, as far as no departing from a technical concept of the invention.

The invention claimed is:

1. A method for manufacturing a high temperature component formed of a Ni-based alloy, the method comprising:

a melting/casting step of melting and casting a material of the Ni-based alloy to form a workpiece;

a hot die forging step of subjecting the workpiece to hot die forging using predetermined dies to form a forge-molded article, the predetermined dies being formed of a precipitation-strengthened Ni-based superalloy comprising a γ phase as a matrix and a γ' phase; and a solution/aging treatment step of subjecting the forge-molded article to solution treatment and aging treatment to form a precipitation-strengthened molded article, wherein the hot die forging step comprises:

a die/workpiece co-heating sub step of heating the workpiece to a forging temperature together with the dies using a heater with the workpiece interposed between the dies; and a hot forging substep of taking the workpiece and the dies heated to the forging temperature out of the heater into a room temperature environment and immediately performing hot forging on the workpiece using a press machine, wherein in the predetermined dies of the precipitation-strengthened Ni-based superalloy, the γ' phase is precipitated in an amount of equal to or more than 10 vol. % with respect to the γ phase at 1050° C., wherein a solvus temperature of the γ' phase is higher than 1050° C. and lower than 1250° C., and wherein the γ' phase has two precipitation forms of intra-grain γ' phase crystal particles that precipitate within crystal grains of the γ phase and inter-grain γ' phase crystal particles that precipitate between or among crystal grains of the γ phase.

2. The method for manufacturing the component formed of the Ni-based alloy according to claim 1, wherein the precipitation-strengthened Ni-based superalloy has a composition of: by mass, 10 to 25% of Cr;

more than 0% and equal to or less than 30% of Co;

1 to 6% of Al;

2.5 to 7% of Ti and 3 to 9% in total of Ti, Nb and Ta;

equal to or less than 4% of Mo;

equal to or less than 4% of W;

equal to or less than 0.08% of Zr;

equal to or less than 10% of Fe;

equal to or less than 0.03% of B;

equal to or less than 0.1% of C;

equal to or less than 2% of Hf;

equal to or less than 5% of Re; and a balance of Ni with inevitable impurities.

3. The method for manufacturing the component formed of the Ni-based alloy according to claim 1, wherein the forging temperature is equal to or higher than 900° C. and equal to or lower than a temperature lower than the solvus temperature of the γ' phase in the precipitation-strengthened Ni-based superalloy by 20° C.

4. The method for manufacturing the component formed of the Ni-based alloy according to claim 1, wherein the dies have a tensile strength of equal to or more than 450 MPa at 900° C.

5. The method for manufacturing the component formed of the Ni-based alloy according to claim 1, wherein the method further comprises a softening step of preforming and softening the workpiece between the melting/casting step and the hot die forging step, the softening step comprising:

a preform forming substep of subjecting the workpiece to hot working at a temperature equal to or higher than 1000° C. and lower than a solvus temperature of a γ' phase in the Ni-based alloy to form a preform in which crystal particles of the γ' phase are precipitated between or among crystal grains of a γ phase as a matrix of the Ni-based alloy; and a softened preform forming sub step of re-heating the preform to the temperature of the hot working to decrease γ' phase crystal particles precipitated within the γ phase crystal grains and subsequently slowly cooling the heated preform at a cooling rate of equal to or less than 100° C./h to 500° C. to form a softened preform in which the inter-grain γ' phase crystal particles have grown, and wherein the hot die forging step is performed on the softened preform.

* * * * *